United States Patent [19]

Oleksiak et al.

[11] 4,268,027

[45] May 19, 1981

[54] SHEET FEEDING APPARATUS

[75] Inventors: Richard L. Oleksiak, Lincolnwood; George P. Niesen, Mt. Prospect, both of Ill.

[73] Assignee: A. B. Dick Company, Chicago, Ill.

[21] Appl. No.: 87,209

[22] Filed: Oct. 22, 1979

[51] Int. Cl.[3] ..... B65H 1/12

[52] U.S. Cl. ..... 271/153; 271/156; 271/157; 271/160

[58] Field of Search ..... 271/147, 152, 153, 156, 271/157, 160

[56] References Cited

U.S. PATENT DOCUMENTS

| | | | |
|---|---|---|---|
| 6,745 | 11/1875 | Heyl et al. | 271/160 |
| 416,674 | 12/1889 | Groth | 271/160 X |
| 419,014 | 1/1890 | Groth | 271/160 X |
| 1,285,432 | 11/1918 | Schults . | |
| 2,373,746 | 4/1945 | Dager | 271/156 |
| 2,431,542 | 11/1947 | Caruso | 271/160 X |
| 4,049,257 | 9/1977 | Frystak | 271/160 X |

FOREIGN PATENT DOCUMENTS

| | | | |
|---|---|---|---|
| 363494 | 12/1931 | United Kingdom | 271/152 |
| 2019366 | 10/1979 | United Kingdom | 271/160 |

*Primary Examiner*—Robert W. Saifer

*Attorney, Agent, or Firm*—Peter S. Lucyshyn

[57] ABSTRACT

A movable platform supports a stack of sheets, with at least a portion of the stack being in a predetermined feed zone where feeding apparatus engages and feeds the sheets, one-at-a-time, from the feed zone into processing machinery. Biasing means continuously urge the platform toward the feed zone and are responsive to a controller for advancing additional sheets of the stack into the feed zone as the sheets are fed therefrom. A sensor is responsive to removal of sheets from the feed zone to energize the controller for enabling the biasing means to advance the table when sheets are not present in the feed zone and to deenergize the controller for disabling the biasing means and terminating movement of the platform when sheets are present in the feed zone.

5 Claims, 9 Drawing Figures

FIG. 4
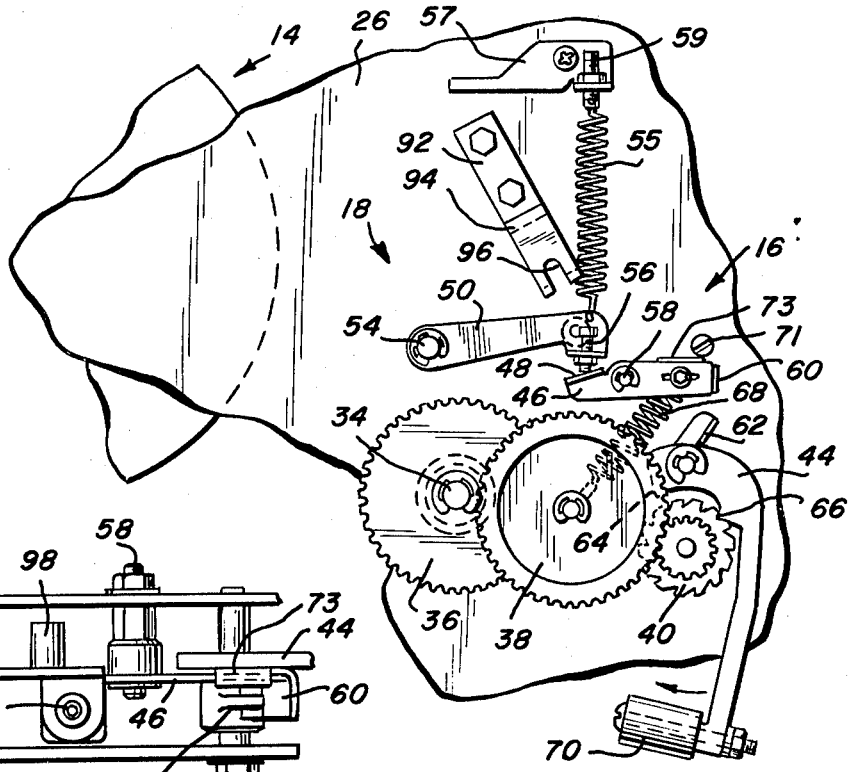
FIG. 6
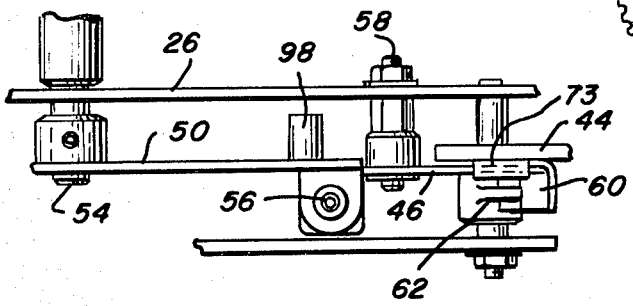
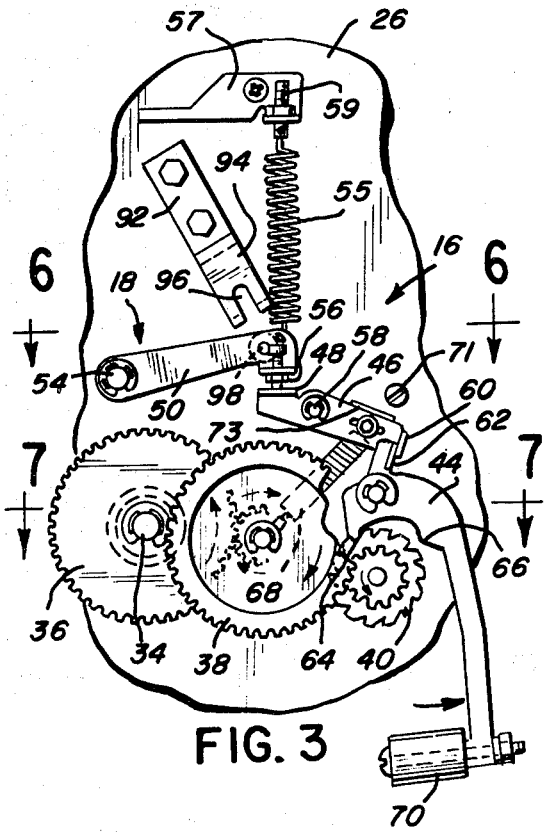
FIG. 3
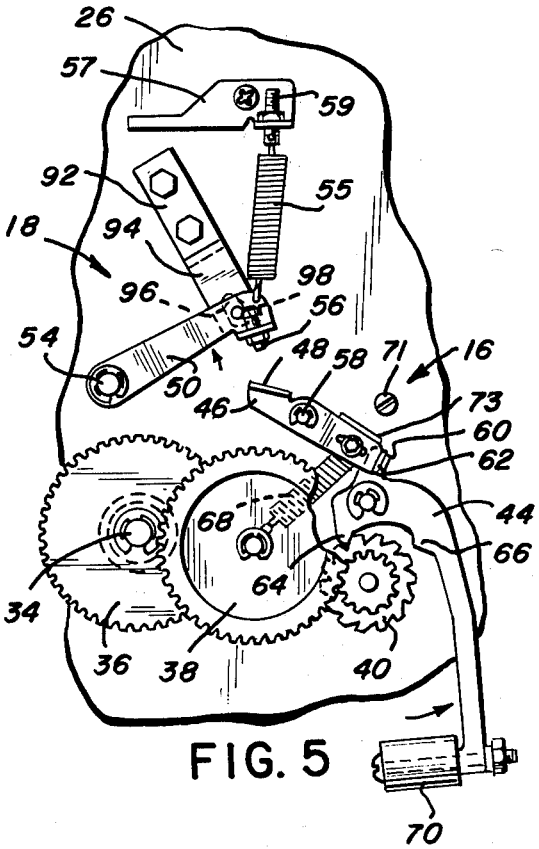
FIG. 5

SHEET FEEDING APPARATUS

BACKGROUND OF THE INVENTION

1. Field of the Invention

This invention relates to sheet feeding apparatus of the type by which single sheets may be successively fed from a stack of sheets, and is particularly directed to a sheet feeding apparatus including a movable platform for supporting the stack and the means for automatically moving the platform as successive sheets are fed from the stack so as to maintain a portion of the stack of sheets within a predetermined feed zone.

2. Description of the Prior Art

In processing machinery such as, by way of example, duplicating machines and the like, it is generally necessary to successively feed single sheets of material into the machine at a fairly high rate of speed while maintaining accurate registration of the sheets with the processing apparatus. In addition, it is desireable to store and successively feed a large quantity of sheets without requiring shutdown for reloading, thus maximizing the efficiency of the operation. To accomplish this, it is generally known to provide means for supporting a stack of sheets in or adjacent a feed zone and feed the sheets from the zone, one-at-a-time, into the apparatus. Generally, a movable platform or table is provided for supporting the stack and as the sheets are fed from the stack, the platform is advanced to move additional sheets into the feed zone.

In the duplicating art, for example, it is known to provide a mechanism for automatically raising a platform structure in order to maintain a portion of the stack of sheets at a predetermined level during feeding of the sheets into the machine. For example, as shown in U.S. Pat. No. 1,989,911, a platform adapted for supporting a stack of copy sheets is disposed such that the sheets are readily engaged by feed rollers and advanced into the duplicating machine. The platform rests on two pairs of levers with each pair being fixed to a rotatable shaft. The table is automatically raised in stages as sheets are fed from the sheet stack by the feed rollers by a ratchet segment which is attached to the shaft and is adapted to be engaged by a reciprocating pawl. When the reciprocating pawl engages the ratchet, it moves the ratchet segment and thereby raises the table. The reciprocating movement is given to the pawl by a rotatable cam fixed to a moving shaft of the duplicating machine. The pawl is normally biased out of engagement with the ratchet segment and is thrown into engagement with the ratchet segment only when the top sheet of the stack is below the predetermined feeding level. The device for throwing the pawl into engagement with the ratchet segment is controlled by the height of the feed roller as it cradles back and forth, depending upon the height of the top sheet in the stack. Over the years, cam driven raising mechanisms have been refined, as shown for example in U.S. Pat. No. 3,652,083. Additional cam driving mechanisms for sheet feeding apparatus are also illustrated in U.S. Pat. Nos. 2,204,715 and 3,883,132.

As operation of duplicating and copying machines became simplified and their use more commonplace, it became desireable to minimize the sheet handling mechanisms. For example, many copy machines are now equipped with spring-loaded platforms or cassettes for holding a quantity of sheets, the spring force continuously urging the uppermost sheet into engagement with the feed rollers of the machine. A problem with this type of device is caused by the spring force system, wherein the actual force with which the sheets are urged into engagement with the feed rollers varies depending upon the weight of the stack and the working length of the spring. Because of this, the quantity of sheets that can be stored and fed with this type of device is necessarily limited.

SUMMARY OF THE INVENTION

The present invention overcomes the drawbacks most common to known sheet feeding systems, providing for a movable platform which is adapted for automatically advancing as much as a full ream of paper into a feed zone without requiring any power from the associated processing machinery.

In accordance with the teachings of the invention, there is provided a movable platform which is always biased toward the feed zone for supporting a stack of sheets to be fed, individually, into a machine. Control means are provided for selectively enabling and disabling the biasing means in response to a sensor which is responsive to the presence of sheets in and removal of sheets from the feed zone. Means for metering the movement of the platform is provided, whereby the platform is automatically moved in a controlled manner to bring a portion of the stack of sheets into the feed zone. For example, a pawl and ratchet mechanism in the design of the clock escapement may be used, wherein the metering is provided by a weighted pawl which defines a weighted pendulum movement, the escapement gear defining a ratchet which has metered rotation controlled by the weighted pawl pendulum. The control means are adapted for locking the pawl into engagement with the ratchet, whereby rotation of the ratchet is precluded unless the control means is actuated in response to the sensor.

It is, therefore, an object of the invention to provide for a sheet feeding apparatus adapted for maintaining a stack of sheets within a predetermined feed zone during feeding of the sheets into processing machinery. It is also an object of the invention to provide means for automatically advancing the stack of sheets into the predetermined feed zone without using or depending on the power utilized for operating the processing machinery. It is an additional object of the invention to provide for a sheet feeding apparatus which will store and feed as much as a full ream of paper without reloading.

Further objects and features of the invention will be readily apparent from the accompanying drawings and from the detailed description which follows.

BRIEF DESCRIPTION OF THE DRAWINGS

FIG. 3 is a fragmentary side elevation view of the apparatus shown in FIG. 2, with the control means disposed in the deenergized condition.

FIG. 4 is a view similar to FIG. 3, with the control means disposed in the energized condition.

FIG. 5 is a view similar to FIG. 3, with the sensor means shown in the locked, deactivated condition.

FIG. 6 is a fragmentary section view taken generally at the line 6—6 of FIG. 3.

DESCRIPTION OF THE PREFERRED EMBODIMENT

Figure 1:
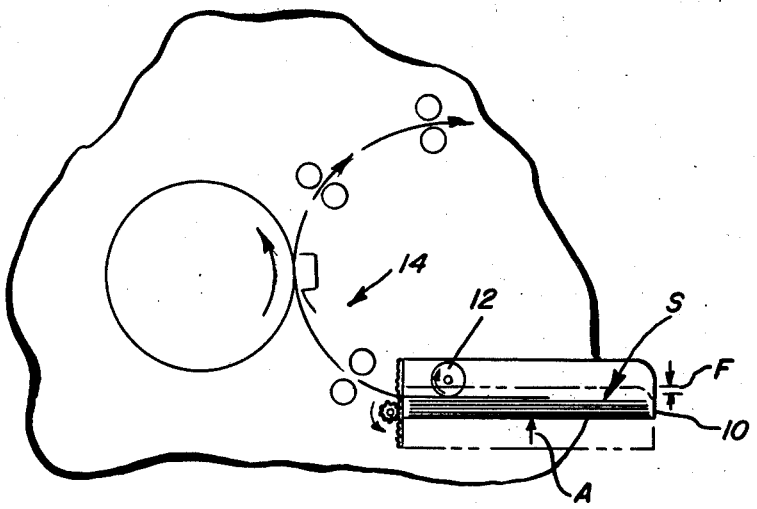
FIG. 1 is a diagrammatic illustration of processing machinery incorporating the features of the present invention.

While the sheet feeding apparatus of the present invention is particularly well suited for storing and feeding a stack of copy sheets, one-at-a-time, into a duplicating machine or the like, it will be readily recognized that the device of the present invention may be adapted for many other operations which call for the sequential feeding of sheet material into a process or machine. As diagrammatically shown in FIG. 1, a movable platform or table 10 supports a stack of sheets S a portion of which is disposed in a feed zone F, whereby feed means such as a set of feed rollers 12 can engage the uppermost sheet in the stack and feed it from the feed zone into the processing equipment diagrammatically illustrated at 14.

In accordance with the present invention, the platform is normally biased for movement for advancing the stack of sheets into the feed zone, wherein control means operably connected to the platform normally disable the biasing means to terminate movement of the platform, the control means being selectively energizable by sensing means responsive to removal of sheets from the stack for enabling the biasing means to move the platform and advance the stack of sheets. As particularly shown in the drawings, the biasing means may comprise tension springs 20 (FIGS. 7–9) which are operably connected to the platform 10 for continuously urging it in the direction of arrow A toward the feed zone. The control means 16 normally disable the biasing means and are operable in response to the sensing means 18 to enable the biasing means for advancing the platform 10 toward the feed zone whenever the uppermost sheet in stack S is outside the feed zone. Using the teachings of the present invention, it is possible to maintain the top sheet of the stack S within a 50 thousandths inch feed zone by advancing the platform 10 through enablement of the biasing means in response to the control and sensing means.

Figure 2:
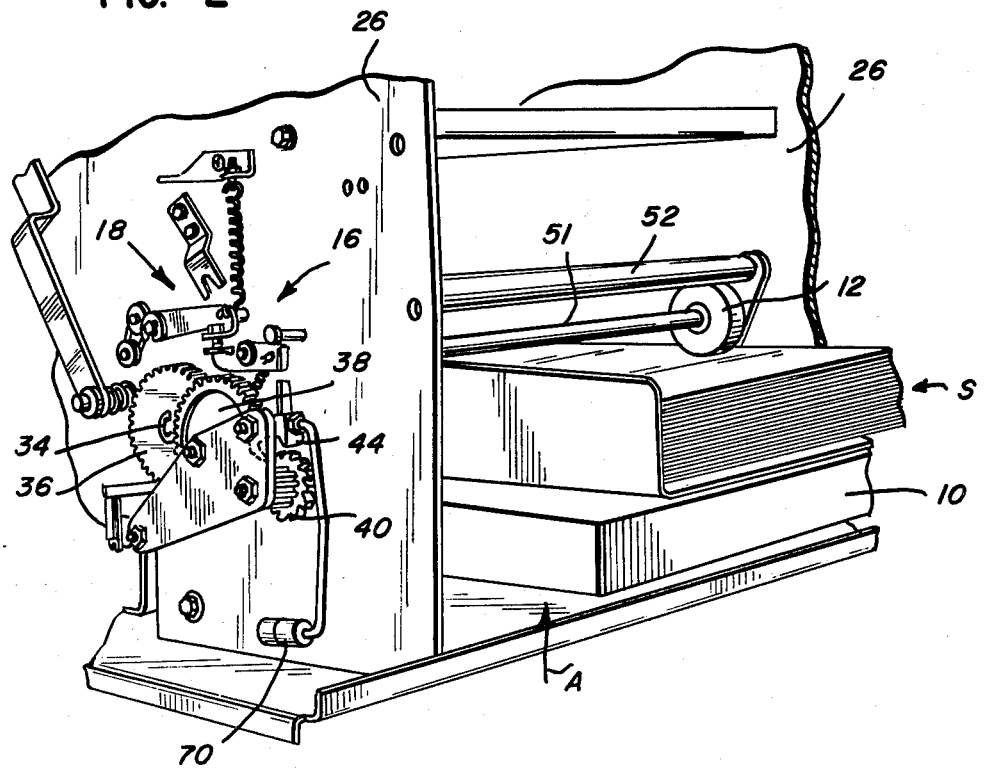
FIG. 2 is a perspective view of a preferred embodiment of the invention.

As will be explained in detail herein, the biasing springs 20 and table 10 are in direct driven relationship with a circular ratchet 40 which is engaged by an indexing pawl 44 (FIG. 2). As the table 10 advances in the direction of arrow A due to the biasing force of the springs, the ratchet rotates and the indexing pawl meters or controls the movement of the table. A weighted pendulum 70 determines the reciprocating speed of the indexing pawl.

The control means 16 is adapted for normally engaging the pawl and locking it with the ratchet, precluding movement of the table and thus the top of the stack S. As the feed rollers 12 feed sheets out of the feed zone, the top of the stack S falls below the feed zone. The sensing means is responsive to this condition for actuating the control means to release the pawl, allowing the springs 20 to advance the table as controlled by the rotating ratchet 40 and reciprocating, indexing pawl 44. As the top of the stack S again enters the feed zone, the sensing means 18 is responsive to this condition to deactivate the control means 16, whereby the pawl and ratchet are again locked, precluding further movement of the table. The cycle is repeated when the top of the stack S is again outside of the feed zone.

Figure 8:
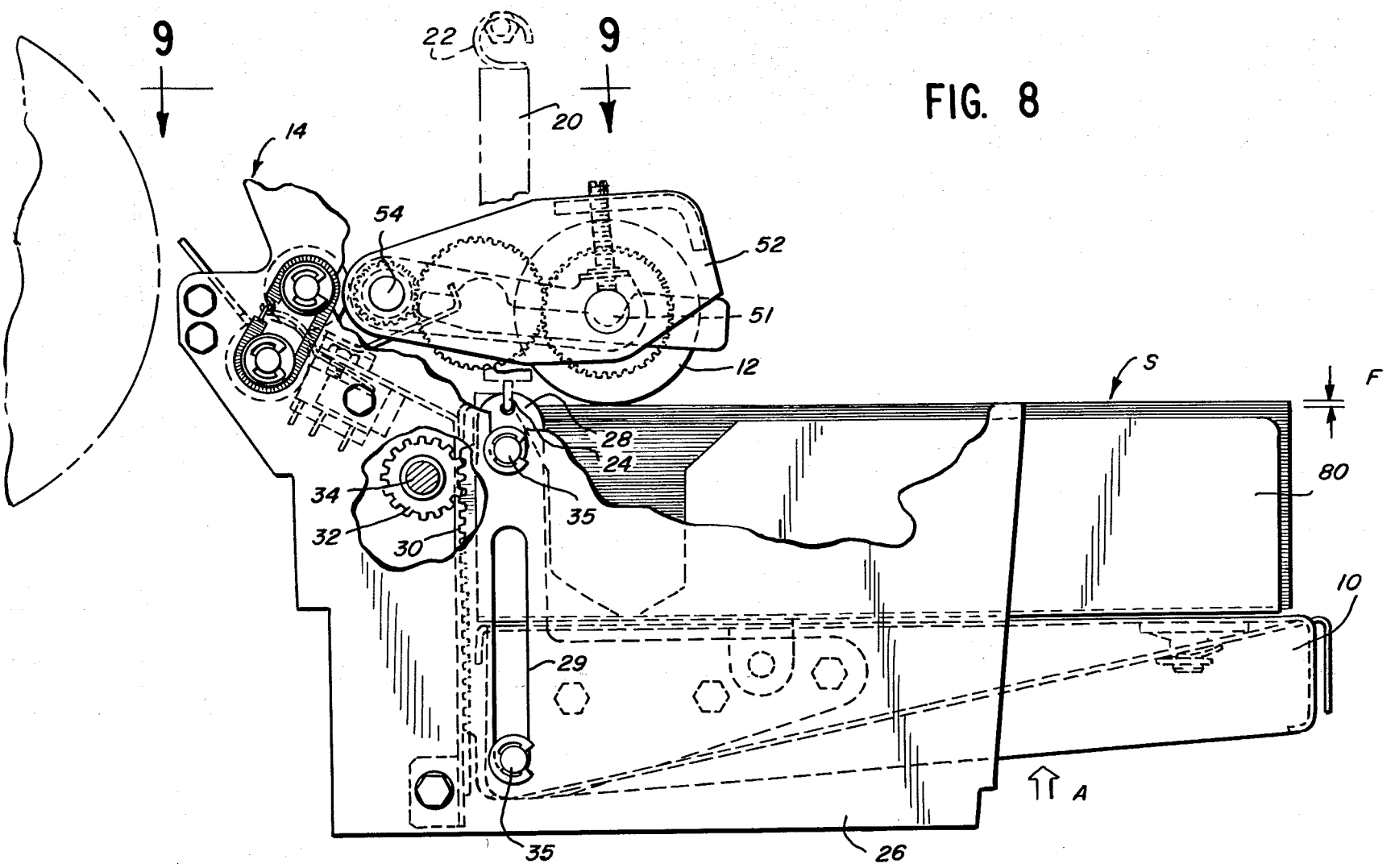
FIG. 8 is a fragmentary section view taken generally at the line 8—8 of FIG. 7.

Turning now to the particular embodiment illustrated in the drawings, it will be noted that the biasing tension springs 20 have opposite ends 22 and 24, respectively, secured to a fixed frame member 26 and to the movable table at the vertical extensions 28. The vertical extensions of the table include movable rack segments 30 which are in engagement with the pinion gears 32 mounted on the rotating drive shaft 34. Posts or guides 35 extend outwardly from the vertical extensions 28 and are received by vertical extending channels 29 in frame 26 (FIG. 8). The posts and channels maintain vertical alignment of the table 10 as it moves in response to springs 20. As the springs 20 advance the table 10 toward the feed zone, the racks 30 drive the pinion gears 32 and the shaft 34, for driving the gear train defined by gears 36 and 38 and the circular ratchet or escapement gear 40. Thus, the biasing means 20 act to advance the table 10 and rotate the ratchet 40 in direct relationshiop with one another. Therefore, the biasing means 20 may be disabled and the table may be set in a fixed position by locking the ratchet against rotation. It will be readily understood that biasing means other than tension springs 20 may be used, as long as a continuous force is provided for urging the table 10 in the direction of arrow A.

For counterbalancing the spring force to control or meter the advancement of table 10, in the present instance, the pawl 44 has a pair of teeth 64, 66 which alternately engage the ratchet in the same fashion as a clock escapement as the ratchet rotates in response to the force of springs 20 and as the pawl reciprocates under the control of the weighted pendulum 70. Normally, tooth 64 of the pawl is disposed in locking engagement with the ratchet 40 (FIG. 3) for precluding rotation of the ratchet and precluding corresponding advancement of the table 10. When actuated by the sensing means 18, the control means 16 operates to unlock the pawl, enabling the biasing means to advance the table, as will now be described.

The sensor 18 is operably connected to the feed rollers 12 and responds to a downward movement of the feed rollers at the top of the stack S falls outside the feed zone for actuating the control means 16. In the preferred embodiment, the feed rollers 12 are mounted on a drive shaft 51 rotatably mounted in a cradle 52 which is pivotably mounted to frame 26 at pins 54 (See FIGS. 8–9). Motive means 90 are provided in driving relationship with feed rollers 12 for driving the rollers and feeding sheets from the feed zone in response to a control signal provided by the associated processing machinery. One end of a sensor lever 50 is mounted on pin 54 for pivotable movement with the cradle 52 (See FIG. 3). The opposite end of the lever 50 includes an adjustable depending stop member 56. A tension spring 55 has one end secured to the lever 50 and the other end secured in bracket 59 mounted on the frame 26. Adjusting means 59 provide means for adjusting the length of spring 55 and hence, the position of feed rollers 12 in cradle 52. Thus, the spring 55 provides means for adjusting the force with which the rollers 12 engage the sheets in stack S. A second bracket 92 is secured to frame 26 and includes a raised end portion 94 having a U-shaped channel 96. Lever 50 includes a pin 98 extending rearwardly thereof adapted for engaging channel 96 (FIG. 5), whereby the lever 50 and rollers 12 can be lifted and locked in a deactivated position during reloading operations and the like. Normally, during operation the lever 50 is in the position of FIG. 3.

Adjacent lever 50 is an elongated lever 46 mounted at 58 for pivotable movement relative to frame 26. The lever 46 comprises, in part, the control means 16 and includes at its ends opposite the pivot 58 a seat 48 for receiving the stop member 56 of sensor lever 50, and a latch 60 for engaging and locking the tab 62 provided on pawl 44. A tension spring 68 has opposite ends secured to frame 26 and control lever 46, respectively, for normally biasing the lever into the position of FIG. 3 to lock the pawl 44 in engagement with ratchet 40 and to preclude advancement of the table 10. When sensor lever 50 pivots downwardly, stop 56 engages seat 48 of control lever 46 and pivots latch 60 upward and out of engagement with tab 62 (FIG. 4). This frees the pawl 44 and permits rotation of ratchet 40 in response to the force provided by the biasing springs 20. A positive stop 71 is secured to frame 26 and engages edge 73 of lever 46 to restrict movement thereof in response to pivoting of sensor lever 50. The stop also acts to restrict movement of the feed roller cradle 52 through levers 46 and 50. When the sensor lever 50 again moves to the position of FIG. 3, spring 68 pulls control lever 46 downward, engaging latch 60 with tab 62 to lock the pawl 44 in engagement with the ratchet 40.

Figure 7:
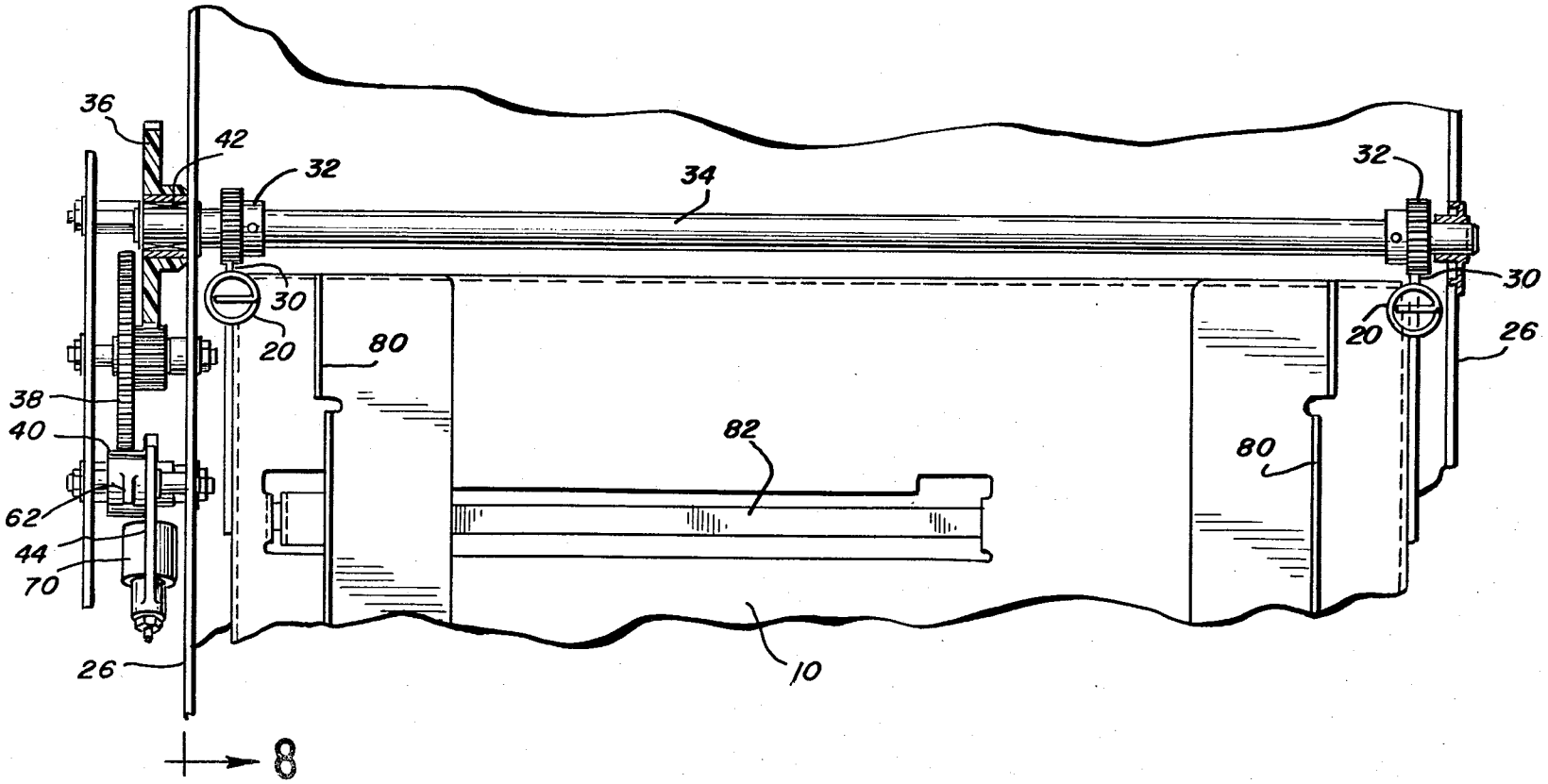
FIG. 7 is a fragmentary section view taken generally at the line 7—7 of FIG. 3.

It is desireable that the movement of the table only be inhibited when it is advanced in the direction of arrow A and that it be free to move in the opposite direction to facilitate reloading regardless of the position of latch 60 and control lever 46. Therefore, as shown in FIG. 7, a one-way clutch 42 is interposed between the drive gear 36 and the pinion drive shaft 34. The clutch 42 is automatically engaged for driving gear 36 when the pinion gear 32 is rotated by movement of the table 10 in the direction of arrow A. When the table 10 is moved in a position opposite to the direction of arrow A, the clutch 42 automatically disengages the gear 36 from the pinion shaft 34, permitting movement of the table away from the feed zone without corresponding rotation of ratchet 40.

Figure 9:
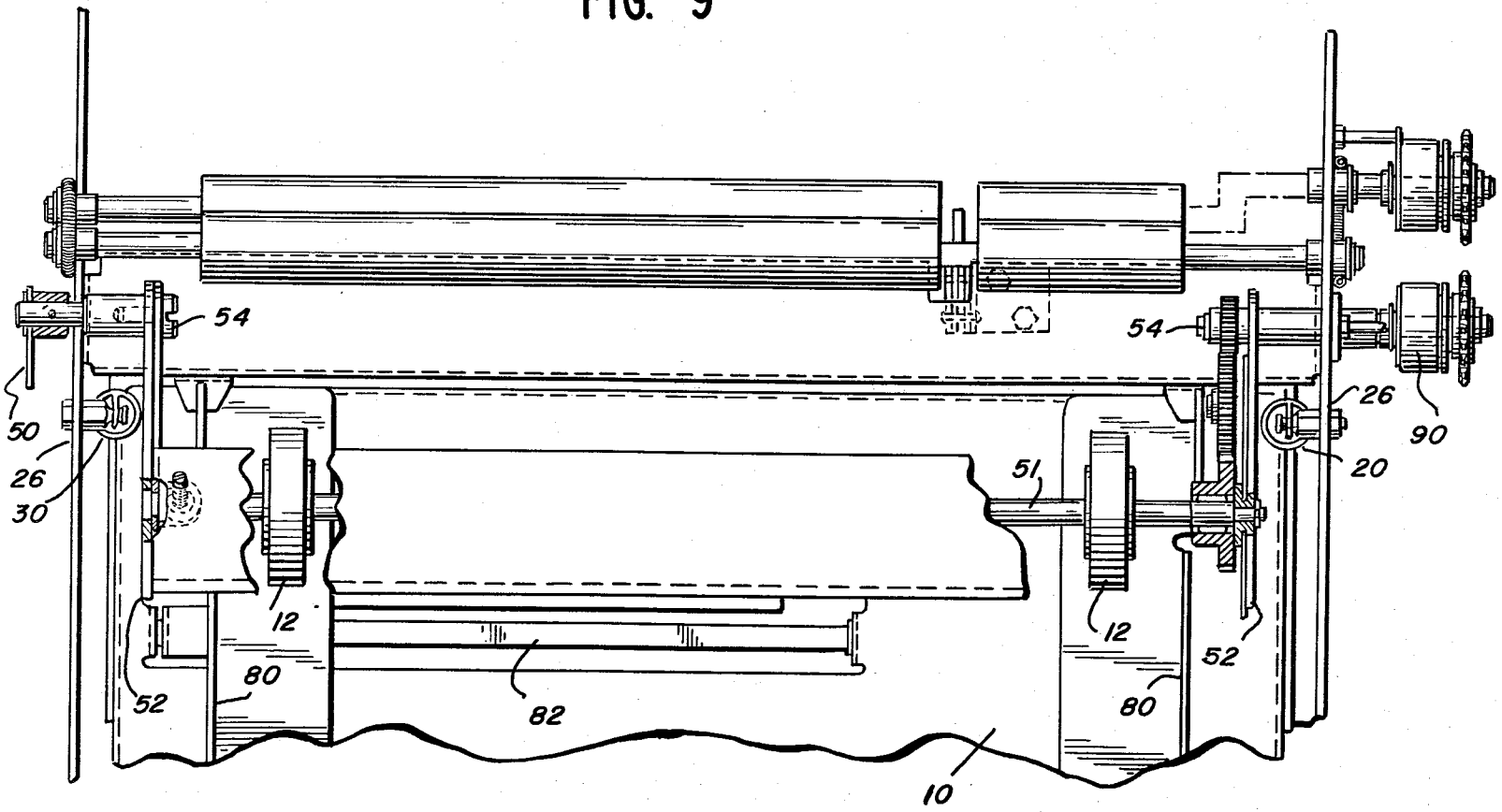
FIG. 9 is a fragmentary view looking in the direction of arrow 9 in FIG. 8.

Also, as shown in FIGS. 7-9, the table 10 of the preferred embodiment includes side rails 80 which engage and register the sheets of stack S when they are supported on table 10. This maintains proper registration of the sheets as they are fed by rollers 12 from the feed zone F into the processing machinery 14. The side rails 80 may be mounted relative to the table 10 on adjustable means such as slide 82, whereby the feeding apparatus of the present invention will accommodate varying sizes of sheets.

In operation of the preferred embodiment, the cradle 52 and sensor lever 50 are initially locked in bracket 92 (FIG. 5) and the table 10 is manually moved away from feed zone F to accommodate a stack of sheet S. The table will move freely in this direction since the one-way clutch 42 is disengaged. However, since sensor lever 50 is deactivated the table will not move upward in response to the biasing springs 20 because latch 60 of control lever 46 is in locking engagement with tab 62 of pawl 44.

The stack S is next loaded on the table 10, and lever 50 is released from bracket 92. Stop 56 drops into engagement with seat 48 of control lever 46 and pivots latch 60 up and out of engagement with tab 62 (FIG. 4) to release pawl 44. The ratchet now rotates in response to the force of springs 20, being metered by the reciprocating weighted pawl 44. As the table raises in the direction of arrow A, the feed rollers 12 and cradle 52 will be lifted by the advancing stack S. The corresponding rotation of shaft 54 will pivot lever 50 and lift stop 56 from the position shown in FIG. 4 to the position shown in FIG. 3, whereby the tension spring 68 pivots lever 46 and latch 60 downward and into engagement with tab 62, again locking the pawl 44 in engagement with ratchet 40 for stopping the rotation of the ratchet 40 and locking the position of pinion gear 32 relative to the rack 30, locking the table against the force of the spring 20. As sheets are fed from stack S the top of the stack will fall below feed zone F and the cradle 52 will drop, pivoting lever 50 and stop 56 to engage seat 48 of control lever 46 and the cycle will be repeated.

While certain embodiments and features have been described in detail herein, it will be understood that the present invention includes any alterations or modifications consistent with the spirit and scope of the appended claims.

What is claimed is:

1. In a duplicating machine including a table movable between raised and lowered positions for advancing a stack of paper sheets into a feed zone, a feed member for engaging individual sheets, drive means for driving the feed member to feed the sheets from the feed zone into the duplicating machine, and improved means for automatically raising the table so as to maintain the top of said stack in said feed zone, the improvement comprising:

(a) biasing means secured to said table for continuously urging the table toward the feed zone;

(b) a pawl and ratchet mechanism, the ratchet being coupled to and moving in direct relationship with the movement of the table, said biasing means continuously urging the movement of the ratchet relative to said pawl;

(c) a cradle for carrying said feed member, the cradle mounted for pivotable movement relative to said machine for maintaining engagement of the feed member with the top sheet of said stack;

(d) a first lever attached for pivotable movement with said cradle;

(e) a second lever having at its opposite ends a seat engageable with said first lever and a stop finger normally in locking engagement with said pawl, said first lever being adapted for engaging the seat upon pivoting of said cradle for pivoting the stop finger out of locking engagement with the pawl; and (f) clutch means for disengaging the ratchet from said table whenever the table is moved away from the feed zone.

2. The apparatus of claim 1, said pawl and ratchet mechanism further comprising a clock escapement mechanism, the pawl including a weighted pendulum movement.

3. The apparatus of claim 1, said biasing means being attached to said table, further including a rack mounted for movement with said table, and a pinion gear engaging said rack and in driving relationship with said ratchet.

4. The apparatus of claim 1, wherein said biasing means is a tension spring having opposite ends attached to the table and copying machine.

5. In a duplicating machine including a table movable between raised and lowered positions for supporting a stack of paper sheets having a top portion with an uppermost sheet, a feed member for engaging the uppermost sheet of the stack in a feed zone, means for driving the feed member to feed sheets from the feed zone into the duplicating machine, biasing means coupled to said table for continuously urging the table toward its raised position, and improved means for automatically raising the table so as to maintain the top portion of the stack in the feed zone, the improvment comprising:

(a) a pawl and ratchet mechanism, the ratchet being coupled to and moving in direct relationship with the movement of the table, said biasing means continuously urging the movement of said ratchet relative to said pawl;

(b) clutch means for disengaging the ratchet from said table whenever the table is moved away from the feed zone;

(c) selectively operable pendulum means connected to said pawl for actuating said pawl to release said ratchet and permit the table to move upwardly, and (d) sensor means coupled to said pendulum means and responsive to the top portion of the stack being lowered to a predetermined level to enabling operation of said pendulum and disabling said pendulum upon raising of the top portion of the stack to another higher predetermined level.

* * * * *

UNITED STATES PATENT AND TRADEMARK OFFICE

CERTIFICATE OF CORRECTION

PATENT NO. : 4,268,027

DATED : May 19, 1981

INVENTOR(S) : Richard Z. Oleksiak and George P. Niesen

It is certified that error appears in the above-identified patent and that said Letters Patent are hereby corrected as shown below:

Middle initial of inventor Oleksiak should read "Z"

Column 4, line 44, "feed rollers at" should read "feed rollers as"

Column 8, line 9, "lowered to a predetermined level to" should read "lowered to a predetermined level for"

Signed and Sealed this

*Twenty-ninth* Day of *September 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,268,027

DATED : May 19, 1981

INVENTOR(S) : Richard Z. Oleksiak et al

It is certified that error appears in the above—identified patent and that said Letters Patent is hereby corrected as shown below:

On the cover sheet, middle initial of inventor Oleksiak should read -- Z --.

Column 4, line 44, "feed rollers at" should read -- feed rollers as --.

Column 8, line 9, "lowered to a predetermined level to" should read -- lowered to a predetermined level for --.

Signed and Sealed this

Tenth Day of November 1981

[SEAL]

*Attest:*

GERALD J. MOSSINGHOFF

*Attesting Officer*

*Commissioner of Patents and Trademarks*